US005621979A

United States Patent [19]

Taylor

[11] Patent Number: 5,621,979

[45] Date of Patent: Apr. 22, 1997

[54] DRIVE ATTACHMENT DEVICE, PARTICULARLY FOR A PAINT BRUSH

[76] Inventor: David B. Taylor, Unit 1d Oldmixon Crescent, Weston Super Mare, Avon, BS24 9AX, United Kingdom

[21] Appl. No.: 500,935

[22] PCT Filed: Jan. 27, 1994

[86] PCT No.: PCT/GB94/00163

§ 371 Date: Jul. 27, 1995

§ 102(e) Date: Jul. 27, 1995

[87] PCT Pub. No.: WO94/16909

PCT Pub. Date: Aug. 4, 1994

[30] Foreign Application Priority Data

Jan. 27, 1993 [GB] United Kingdom ..... 9301596

[51] Int. Cl.[6] ..... F26B 17/24

[52] U.S. Cl. ..... 34/58; 248/522; 248/655

[58] Field of Search ..... 34/58; 192/65, 192/79, 107 T; 403/44, 302, 343; 248/565, 652, 655, 665, 522

[56] References Cited

U.S. PATENT DOCUMENTS

| | | | |
|---|---|---|---|
| 2,794,265 | 6/1957 | Kruger | 34/58 |
| 2,895,154 | 7/1959 | Belcher | 34/58 |
| 2,931,661 | 4/1960 | Harris | 34/58 |
| 3,436,264 | 4/1969 | Allen | 34/58 |
| 3,925,908 | 12/1975 | Dunn | 34/58 |
| 4,668,119 | 5/1987 | Galletti | 403/343 X |
| 4,895,339 | 1/1990 | Yang et al. | 248/522 |
| 5,052,653 | 10/1991 | Coraccio | 248/655 X |
| 5,185,938 | 2/1993 | Hutt | 34/58 |
| 5,190,261 | 3/1993 | Tetting | 248/522 |

*Primary Examiner*—John M. Sollecito
*Assistant Examiner*—Steve Gravini
*Attorney, Agent, or Firm*—Gifford, Krass, Groh, Sprinkle, Patmore, Anderson & Citkowski, P.C.

[57] ABSTRACT

A drive attachment device (10), particularly adapted to receive and transmit drive to the handle (31) of a paint brush (30) comprises a body (11) having a socket (12) for receiving the end of a paint brush, and resilient retaining means in the form of tension springs (17) mounted on pegs (16) to span an opening (18) through which the handle (31) of the paint brush (30) is introduced when being fitted to the device. The tension springs exert sufficient force on the paint brush handle both to retain it in position against axial displacement and to transmit rotation when the body (10) is rotated.

6 Claims, 1 Drawing Sheet

DRIVE ATTACHMENT DEVICE, PARTICULARLY FOR A PAINT BRUSH

The present invention relates to a drive attachment device, particularly for enabling rotary drive to be transmitted to a paint brush.

It is well known that paint brushes are difficult to clean because of the quantity of paint soaked up by their bristles and the fact that this penetrates to their roots. Conventionally paint brushes are cleaned by soaking and rinsing in water or some other suitable solvent but this basic method takes a considerable length of time, requires large amounts of the solvent, and even then, may leave paint trapped in the roots.

Attempts have been made to find other, less time consuming methods of removing paint from paint brushes and these have included centrifuging the brushes at high speed about their longitudinal axes. Although this method is more effective than simple soaking and rinsing, apparatus for achieving it has not to date been provided which is sufficiently economical and convenient for widespread use, particularly in the domestic market where such apparatus would be most welcome. It is not, for example, possible for them to be gripped adequately by attachment devices such as chucks of domestic motorised apparatus such as power drills for various reasons: the weight of a paint brush lies in the brush end and to achieve stable rotation of the brush it should be gripped close to the head but chucks in common use would grip the end of the handle remote from the head; paint brush handles are generally irregular in cross-section and cannot be gripped with sufficient force and/or in such a manner by equipment in current general use to maintain them in alignment with the rotational axis; if strong pressure is exerted on a handle to grip it, there is a considerable danger of damage to a paint or varnish layer covering the handle or indeed to the handle itself in view of the fact that it is commonly of wood and can therefore be bruised or dented. Alternative methods of supporting artifacts for rotation by means of two attachments at opposite ends of the artifact are, of course, difficult to apply to paint brushes because of the potential damage to the bristles, the soiling of the attachment at the head end and the difficulty of providing a surrounding casing for catching the centrifuged paint.

An attempt has been made in the prior art to overcome these difficulties, by the provision of an implement for rotating a paint brush to clean it as is shown in UK Patent No. 867,960 comprising a support which can be rotated about an axis and which has a group of resilient fingers which extend generally parallel to the axis and have inwardly turned free ends for gripping a paint brush handle between them. Such equipment is clearly intended to grip the handle relatively close to the brush head but the apparatus as a whole is designed to be rotated manually, that is, not at the high speeds achievable by a motor.

The object of the present invention is to provide an alternative device for enabling an elongate member such as a paint brush handle to be gripped so that rotary drive can be transmitted thereto to rotate it about its axis. Accordingly the present invention provides a drive attachment device comprising a housing defining an axis and adapted to receive drive to rotate it about that axis, the housing having an open end for the axial insertion into the housing of an end portion of an elongate article to which drive is to be transmitted and including means for restraining the inserted end against movement transverse the axis, characterised in that the open end is spanned by at least two resilient gripper members each attached at opposite ends to the housing such that an article must be forced between the gripper members into the housing, the force stretching the gripper members which then grip a part of the article spaced from the inserted end to retain the article in the housing and to transmit rotary drive thereto on rotation of the housing about its axis.

The device of the invention may be used or adapted to attach any elongate member to a drive to rotate it, preferably about its axis, but the present specification is particularly concerned with its use with paint brushes. For this purpose the housing should be sufficiently long to accommodate a substantial portion of the handle, which is commonly between about 100 mm and 150 mm long, with the resilient members gripping it towards the head end. The resilient members should also be capable of gripping a member of non-uniform cross-section.

The housing may be a cage-structure or may have a solid outer peripheral, preferably cylindrical, wall surrounding an elongate cavity for receiving the handle through an open end thereof while the opposite end of the housing is adapted to receive drive to rotate it about the cavity axis. For this purpose the housing may be provided with a handgrip, such as a wheel, by which it can be rotated manually but it preferably has a gear or other means such as an axially-projecting spindle which can be connected to a motor. Preferably a spindle is of such a size that it can be gripped by the chuck of an electric motor of the type commonly used to power domestic hand tools such as drills. The housing and spindle may be of any convenient material of sufficient strength for its use; the spindle is preferably of metal, generally steel, but the housing is preferably molded from plastics material.

The resilient members for gripping the handle are preferably of such a strength and so arranged that they can grip a range of paint brush handles of different sizes. In use the paint brush handle may simply be pushed between the gripper members to open a passage into the housing and will then be gripped by the resilient members tending to return to their original rest conditions. Such members, especially if touching in their rest condition, would preferably present beveled or curved surfaces to the exterior of the housing to act as lead-in surfaces for the insertion of the handle to open the passage between them. In a preferred embodiment of the invention, such elongate members are stressed so as to be concavely curved towards each other to define a passage therebetween even in their rest condition. This arrangement clearly defines a minimum size of paint brush which can be gripped by the device. Such resilient members may be solid bodies, for example of rubber or synthetic material but are preferably constituted by coiled springs.

The provision of a pair of resilient members is a particularly cheap and convenient way of carrying out the invention but should not be considered as limiting. There could, for example, be more than two elongate members extending across the opening.

It is envisaged that a device of the invention may be made in such a manner as to accommodate a reasonable range of sizes of paint brush in current use. Alternatively, however, particularly if it is wished to accommodate a wider range of sizes or elongate members other than paint brush handles, the resilient members may be arranged or mounted in a more complex manner to accommodate such differences. For example, the size and/or shape of the passage between the resilient members in their rest condition may be varied by enabling the relative spacing and/or orientation of the members to each other to be varied. For this purpose, opposite ends of one or each of the members may be anchored to parts of the housing which are movable, for example rotatable, relative to each other. Such an arrangement may be provided for either two or more resilient members extending across the housing to form the passage. Alternatively the resilient members may be provided on a support releasably attachable to the housing and interchangeable with supports carrying different resilient members.

The resilient members may be attached to the housing in any manner appropriate to the materials used. Furthermore they may be permanently attached to the housing, for example by gluing, welding, heat sealing or vulcanizing as appropriate, or they may be releasably attached so that they may be replaced when worn or damaged or may be replaced by alternative resilient members, as indicated above.

One embodiment of the invention will now be more particularly described by way of example, with reference to the appended drawings, in which.

Figure 1:
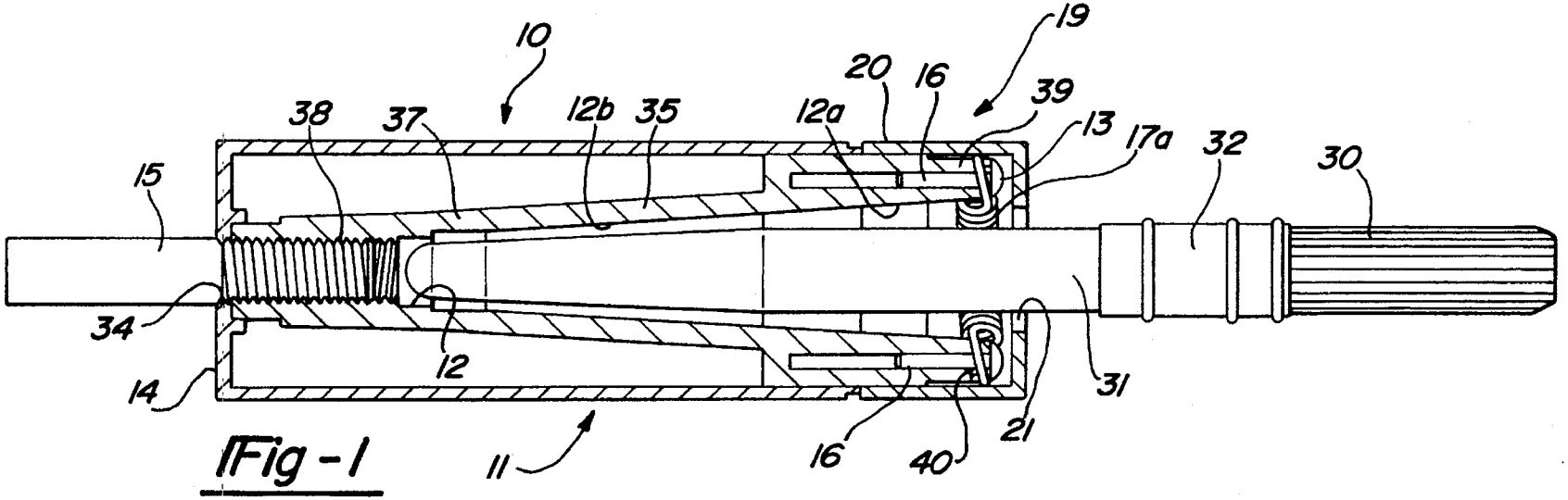
FIG. 1 is a longitudinal axial section through an attachment device in use with a paint brush.

With reference now to the drawings, a drive attachment device is shown generally indicated 10, supporting a paint brush generally indicated 30. The attachment device 10 comprises a cylindrical outer casing 11 having an open end 33 and a closed end 14 with a central opening 34. Within the cylindrical casing 11 is an insert 35 having a cylindrical portion 36 and a tapered portion 37 defining a blind cavity 12 which has a wider portion 12*a* near the open end 13 of the insert 35, and a tapering section 12*b* leading to a closed end of the cavity. At its closed end the tapered portion 37 has an axial hole 38 into which can be threaded a threaded end of a spigot 15 acting as a spindle, as will be described hereinbelow, passing through the opening 34 in the cylindrical casing 11 to retain the insert 37 in position.

Figure 2:
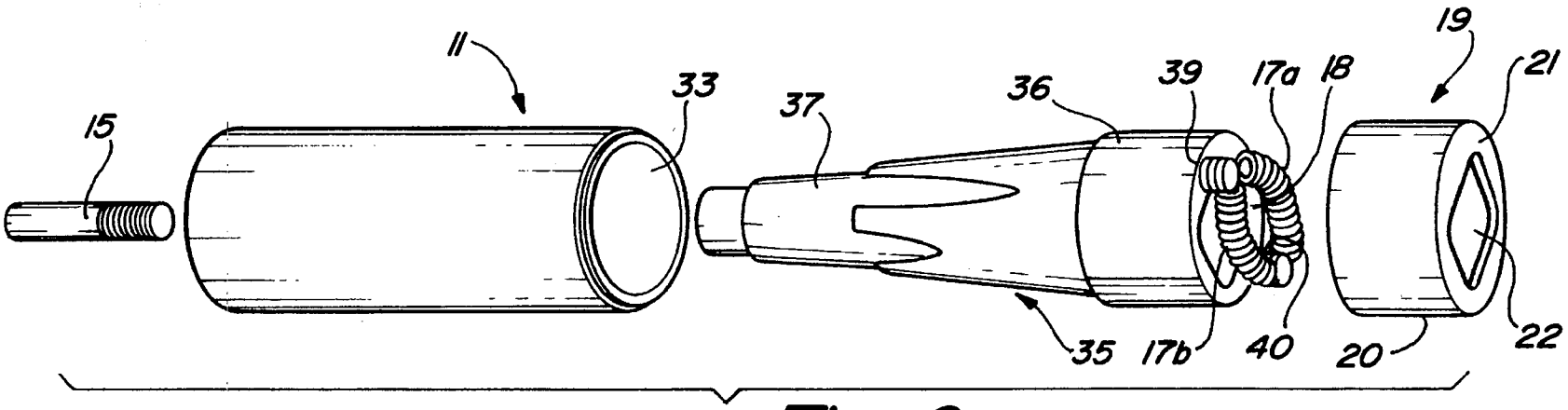
FIG. 2 is an exploded view of the device of FIG. 1.

The annular open end face 13 of the insert 35 has two axially extending cylindrical bosses 39, 40 which receive axially extending pins 16 located in diametrically opposite positions across the open end 13 of the insert 35. Each pin 16 retains corresponding ends of two helical tension springs 17*a*, 17*b* in position on the bosses 39, 40. Because the springs are both retained on common bosses they flex into an arcuately curved shape as can be seen in FIG. 2, being concavely curved towards each other. The springs 17*a*, 17*b* thus define an elongate passage 18 between them.

The attachment device 10 is completed by an annular cover 19 fitted over an open end of the insert 35. The cover 19 has a cylindrical skirt 20 which fits around the insert 35 and approaches closely the open end of the cylindrical casing 11, and has a radially-inwardly projecting flange 21 defining a generally rectangular opening 22 through which the handle 31 of the brush 30 can be introduced into the housing. In this embodiment the longer axis of the cover aperture 22 is perpendicular to the line joining the pins 16.

The cover 19 may be readily releasable from the insert 35, and therefore from the casing, to gain access to the springs 17 for replacement, and for cleaning if required.

In use, the free end of a paint brush handle 31 inserted through the opening 22 in the cover 19 into the passage 18 between the springs 17, with the longer axis of the handle cross-section perpendicular to the longitudinal axis of the passage. The rounded surfaces of the springs 17 facilitate this insertion.

In order to insert the handle 31 further, it must be forced between the springs 17, opening the gap between them. When the handle 31 is fully inserted into the cavity 12 in the casing 11, a portion nearer the brush head 32 is gripped by the resilient pressure exerted on it by the springs 17. Furthermore, the cavity 12 is tapered towards its blind end so as to reduce the clearance between the casing wall and the narrower free end of the handle 31: this helps to steady the paint brush held by the device 10 when it is rotated in use by a motor connected to the spindle 15.

The dimensions of the casing 11 and the dimensions and strength of the springs 17 are such that the attachment device can accommodate the handles of paint brushes in common use having sizes ranging from about 10 mm brush size to 150 mm brush size.

In use, a used paint brush which is soaked in paint is simply inserted into the casing 11 which is attached to a motor by the spindle 15. The brush is then preferably held in a container while it is rotated about its longitudinal axis by the motor. During this initial rotation, a major proportion of the paint is flung from the bristles into the container. The centrifugal action on the bristles opens them apart to free the paint even from the roots thereof to facilitate this initial process.

The brush may then be dipped in a suitable solvent, for example water or white spirit according to the nature of the paint, and is then again rotated by the motor, possibly in a different container. A further quantity of paint diluted with the solvent is then flung from the bristles. This process may be repeated until all the paint, or at least as much as is required, has been removed from the bristles.

In practice it is found that brushes holding fresh paint need to be dipped only two or three times in solvent for practically all of the paint to be removed by this treatment. Furthermore very little solvent is used since there is no need for the repeated rinsing in solvent which is usual if brushes are simply washed in solvent.

In the case of brushes contaminated with hardened paint, they should be soaked in solvent before treatment but subsequent spinning is then effective in removing the paint.

What is claimed is:

1. A drive attachment device comprising:

an elongate, substantially rigid housing body defining an axis, a drive means being received within said housing body to rotate said housing body about said axis, said housing body defining an internal socket arranged coaxial with said axis and having an open end for the axial insertion into said socket of an end portion of an article to which drive is to be transmitted, said socket being shaped to restrain said inserted end against movement transverse to said axis, and said housing body carrying resilient gripper members each attached at opposite edges to a selected end of said housing body adjacent said open end of said socket so as to extend across said open end, said gripper members capable of being stretched and resiliently forced apart upon the insertion of the end portion of the article into said socket between said gripper members and through said open end, said gripper members then gripping resiliently a part of said article spaced from said inserted end to fixedly retain said article in said socket upon rotation of said housing body about said axis.

2. A drive attachment device as claimed in claim 1, having two said resilient gripper members.

3. A drive attachment device as claimed in claim 2, in which said gripper members are stressed in their rest condition so as to be concavely curved towards each other to define a passage therebetween.

4. The drive attachment device as claimed in claim 1, said gripper members further comprising helical tension springs.

5. The drive attachment device as claimed in claim 1, said housing body further comprising an axially projecting spigot secured to said housing body for receiving said drive means.

6. The drive attachment device as claimed in claim 1, for transmitting a rotatable drive to paint brushes, further comprising said socket being shaped to accommodate handles of paint brushes according to varying sizes.

* * * * *